US005411459A

United States Patent [19]

Hayden

[11] Patent Number: 5,411,459

[45] Date of Patent: May 2, 1995

[54] DUMBBELL RACK ATTACHMENT FOR EXERCISE WEIGHT BENCH COLUMN

[76] Inventor: Richard C. Hayden, 1576 Heatherwood Dr., Decatur, Ga. 30033-1705

[21] Appl. No.: 620,702

[22] Filed: Dec. 3, 1990

[51] Int. Cl.[6] ..... A63B 13/00

[52] U.S. Cl. ..... 482/104; 482/108

[58] Field of Search ..... 272/123; 482/104

[56] References Cited

U.S. PATENT DOCUMENTS 4,641,837 2/1987 Ruth ..... 272/123

4,666,150 5/1987 Segrist et al. ..... 272/123

*Primary Examiner*—Stephen R. Crow
*Assistant Examiner*—Jerome Donnelly
*Attorney, Agent, or Firm*—Harry I. Leon

[57] ABSTRACT

A dumbbell rack attachment to be inserted into the column of an exercise weight bench having a single vertical support and a rack assembly with two grooved weight bearing surfaces divided by an open space for the hand to pass through so that the weights of a dumbbell can rest in the grooved weight bearing surface and not roll out.

4 Claims, 4 Drawing Sheets

DUMBBELL RACK ATTACHMENT FOR EXERCISE WEIGHT BENCH COLUMN

FIELD OF THE INVENTION

This invention relates in general to exercise equipment and in particular to the use of dumbbells while exercising.

PRIOR ART

Prior structures of this type have utilized racks to provide a place to rest barbells, barbell plates, or dumbbells while not being used during an exercise workout. Examples are as follows: U.S. Pat. Nos. 4,205,838, 4,412,678 and 4,666,150.

In U.S. Pat. No. 4,205,838 an exercise device useful as a support apparatus for the plates of a barbell is disclosed.

In U.S. Pat. No. 4,412,678 a saddle for supporting the bar of a barbell when said saddle is attached to the columns on an exercise bench is disclosed.

In U.S. Pat. No. 4,666,150, a dumbbell position rack is disclosed having a base, a pair of vertical supports, a guide member, and a U-shaped weight plate support surface.

SUMMARY OF THE INVENTION

The primary object of the present invention is to provide an apparatus to aid athletes who train with weights, specifically dumbbells. The present invention will receive and support a dumbbell safely and comfortably.

It is another object of the invention to provide such an apparatus which can be inserted into the column of an exercise weight bench.

The present invention discloses a dumbbell rack attachment comprising a single vertical support adapted for use with an exercise weight bench column and a J-shaped weight plate support surface that will comfortably receive and support said dumbbell before and after an exercise is performed using said dumbbell.

The present invention is simpler in design then that of the Prior Art in that there is no guide member needed to facilitate the receiving of the dumbbell down onto the J-shaped groove formed by the rack attachment, only one vertical support is required, and the vertical support of said rack attachment can be inserted into an existing column of an exercise weight bench thereby not requiring a base.

It is another object of the present invention to provide a stable support for the weights of a dumbbell, the support including two grooved members for holding the weights, the grooved members being separated from each other by a space through which a user's hand can pass, while holding said dumbbell.

It is another object of the present invention to provide a stable support for the weights of a dumbbell, the support including grooved members with J-shaped weight bearing surfaces for receiving the weights of the dumbbell itself.

It is a still further object of the present invention to provide an apparatus with a simple design which is relatively inexpensive to manufacture but which is also functional as a dumbbell support.

DESCRIPTION OF THE PREFERRED EMBODIMENT

Figure 1:
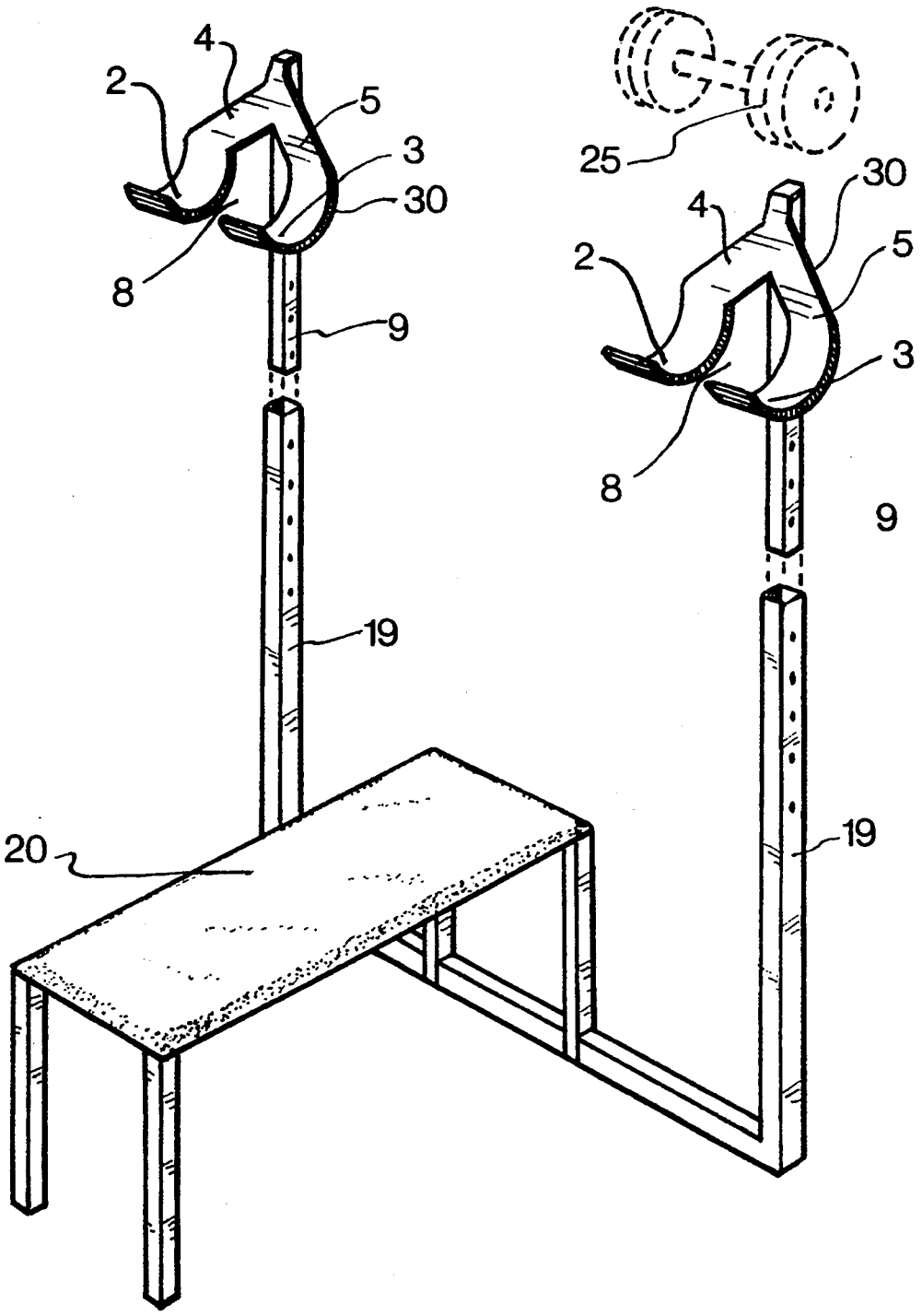
FIG. 1 is a perspective view showing a conventional exercise weight bench with barbell workout capacity modified to include the dumbbell rack attachment according to the present invention.

By referring to FIG. 1 of the drawings, it will be seen that the dumbbell rack attachment according to the present invention comprises a grooved rack assembly 30, attached to a single vertical support 9, which is inserted into the column 19 of an exercise weight bench 20 in order to receive and support a dumbbell 25. It is also evident in FIG. 1 that the dumbbell 25 rests in the J-shaped groove areas formed by body members 2 and 4 and 3 and 5 with a space 8 between said body members 2 and 4 and 3 and 5 intended for the hand to pass through freely.

Figure 2:
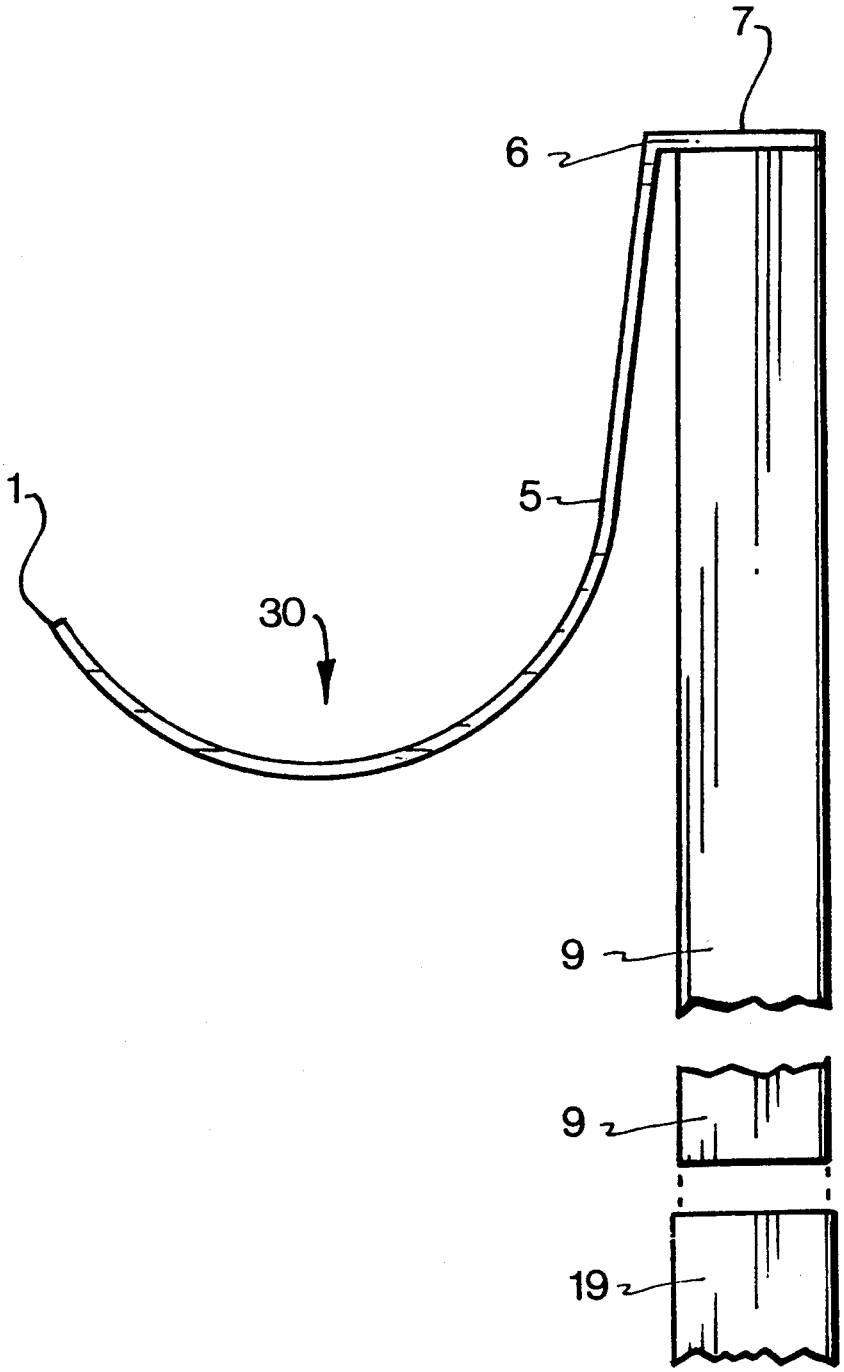
FIG. 2 is a side elevation view of the dumbbell rack attachment according to FIG. 1, the attachment being mounted on a column made for a barbell support.

Refer now to FIG. 2. This is a side view showing the top 7 where it connects to the single vertical support 9. Extending outward from said single vertical support 9 at approximately a 90 degree angle, is body member 6 that then drops at an angle of approximately 80 degrees. This view shows the distinct J-shape groove for the explicit purpose of receiving and supporting a standard dumbbell. The total distance of drop from body member 6 to the lowest part of said J-shape groove is approximately 8½ inches. Body member 1 is approximately 2 inches above the lowest point, and will prohibit the dumbbell from rolling out of the groove formed by the distinct J-shape.

Figure 3:
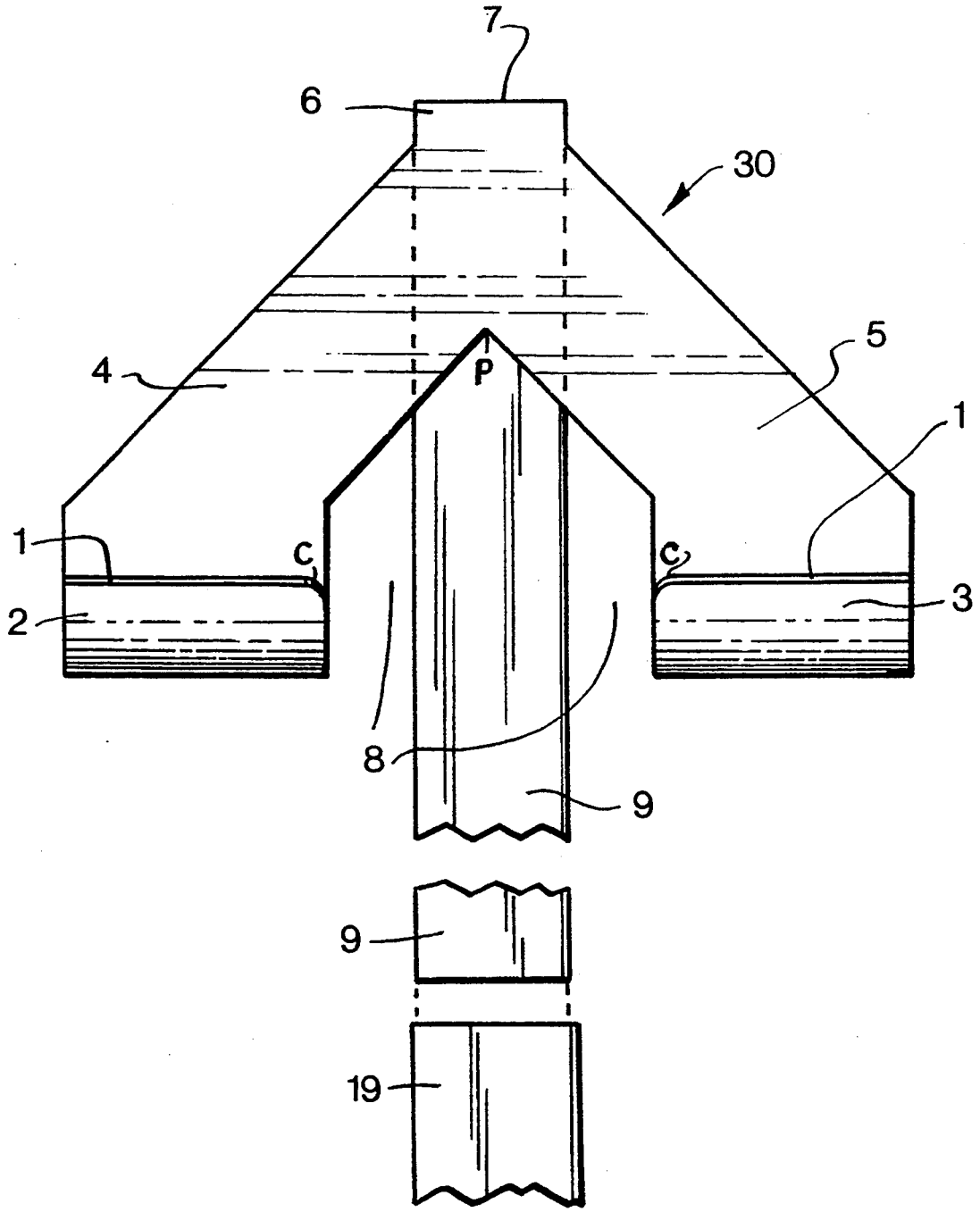
FIG. 3 is a frontal view of the dumbbell rack attachment according to FIG. 1.

Please refer to FIG. 3 for a front view showing the single vertical support 9 which is to be inserted into the column 19 of a standard weight bench resulting in a stabilizing effect. The body member 30 appears as an inverted Y. Readily visible is the open space 8 situated between the two grooved weight bearing surfaces 2 and 4 and 3 and 5.

Figure 4:
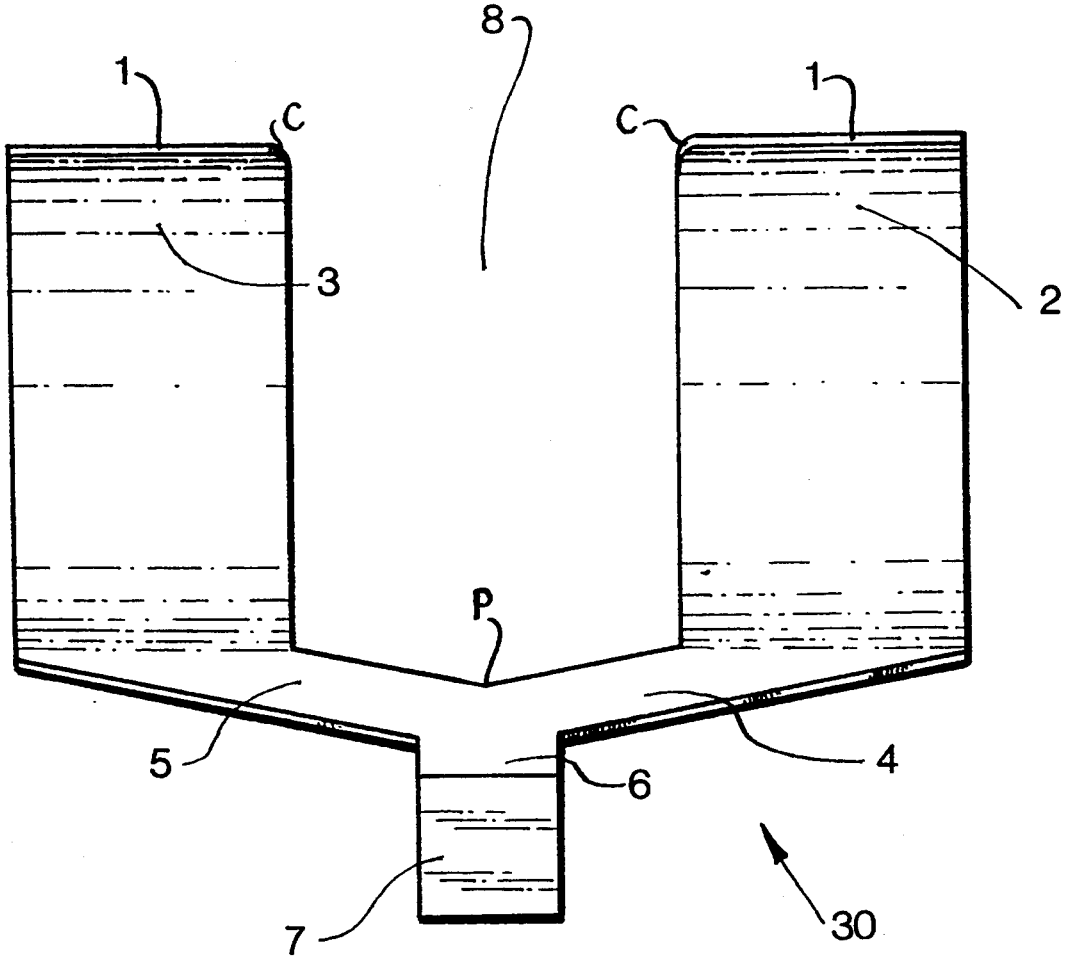
FIG. 4 is a plan view of the dumbbell rack attachment according to FIG. 1.

By focusing on FIG. 4 the top view reveals body member 30. Although no angle of drop or groove for weight bearing purposes is discernible, the drop begins at body member 6 where the sides angle outward at approximately 45 degrees. The open space 8 is approximately 5½ between body members 2 and 3, and extends inward approximately 6" before the 45 degree angles start to move in towards one another to form point P. Body members 2 and 3 are approximately 4" wide. Body member 7 is approximately 2" square. Please note that corners C are rounded off to protect the athlete's hand from possible injury due to sharp corners.

The present invention comprises the single vertical support and the grooved rack assembly. Alternate versions of the present invention could include the presence of holes drilled through the vertical support to facilitate the raising of said invention for various exercises. Another alternate version of the present invention could be with use of a barbell lightly weighted with barbell weight plates.

To summarize, the Dumbbell Rack Attachment for Exercise Weight Bench Column is an aid to athletes training with weights and specifically dumbbells. Used for its intended purpose when the single vertical support is inserted into a Exercise Weight Bench Column, the present invention successfully receives and supports a dumbbell. The distinct J-shaped grooved rack assembly with the opening for the hand to pass through reveals this invention to be simple in design as well as functionalistic.

The preceding description of the preferred embodiment of the invention has been presented for the purpose of illustration and description. It is not intended to be exhaustive or to limit the invention to the precise form disclosed. Many modifications and variations are possible in light of the above teaching. It is intended that the scope of the invention be limited not by this detailed description, but rather to the claims appended hereto.

Having thus described my invention what I claim is:

1. A dumbbell support for use with a barbell exercise weight bench having a pair of vertical tubular members between which the bench is disposed, said support comprising a single rod for insertion into the upper end of one of the tubular members, a grooved rack assembly which is attached to the rod, the rack assembly having two body members for supporting a standard dumbbell which extend downwardly from the points of attachment of the grooved rack assembly to the rod, the body members being spaced sufficiently far apart from each other to permit the insertion of a hand therebetween to allow for a person to manipulate the dumbbell.

2. The dumbbell support according to claim 1 in which the upper end of the grooved rack assembly below said points of attachment drops downwardly at an angle of approximately 80 degrees to the horizontal, the portion of the grooved rack assembly below said points of attachment of the rod thereto being curved so as to be distinctly J-shaped when viewed from one side of the dumbbell support.

3. The dumbbell support according to claim 1 which further comprises means for adjusting securely the rod at various heights within the vertical tubular member.

4. A holder adapted to support a dumbbell on a standard barbell tubular support column having a plurality of holes spaced apart longitudinally from each other, comprising:

(a) a single rod for insertion into the upper end of said support column;

(b) a grooved rack assembly which is attached to the rod, the rack assembly having two body members for holding a standard dumbbell, the body members being spaced sufficiently far apart to permit the insertion of a hand therebetween to allow for a person to manipulate the dumbbell, the portion of the rack assembly situated below the points of attachment of the rod to the rack assembly being curved so as to be distinctly J-shaped when viewed from one side of the dumbbell support, the upper end of the J-shaped portion dropping downwardly nearly vertically and substantially parallel to the rod; and (c) means engageable with at least one of said holes for adjusting securely the rod at various heights within the tubular support column.

* * * * *